United States Patent [19]

Blosser et al.

[11] Patent Number: 4,641,057

[45] Date of Patent: Feb. 3, 1987

[54] SUPERCONDUCTING SYNCHROCYCLOTRON

[75] Inventors: Henry G. Blosser; Bruce F. Milton, both of East Lansing, Mich.; Jack Riedel, deceased late of East Lansing, Mich.; Margaret Riedel (executrix).

[73] Assignee: Board of Trustees operating Michigan State University, East Lansing, Mich.

[21] Appl. No.: 693,859

[22] Filed: Jan. 23, 1985

[51] Int. Cl.[4] ..... H05H 13/02

[52] U.S. Cl. ..... 313/62; 328/234; 328/235

[58] Field of Search ..... 328/234, 235; 313/62

[56] References Cited

U.S. PATENT DOCUMENTS 3,868,522 2/1975 Bigham et al. ..... 313/62

*Primary Examiner*—David K. Moore
*Assistant Examiner*—K. Wieder
*Attorney, Agent, or Firm*—Ian C. McLeod

[57] ABSTRACT

A synchrocyclotron with superconducting coils (1) is described. The coils are provided in a vessel (4) which is supported by low heat leak members (6) in a cryostat (7). A liquified gas (helium) is provided in the vessel to cool the coils so as to render them superconducting.

11 Claims, 2 Drawing Figures

SUPERCONDUCTING SYNCHROCYCLOTRON

Figure 1:
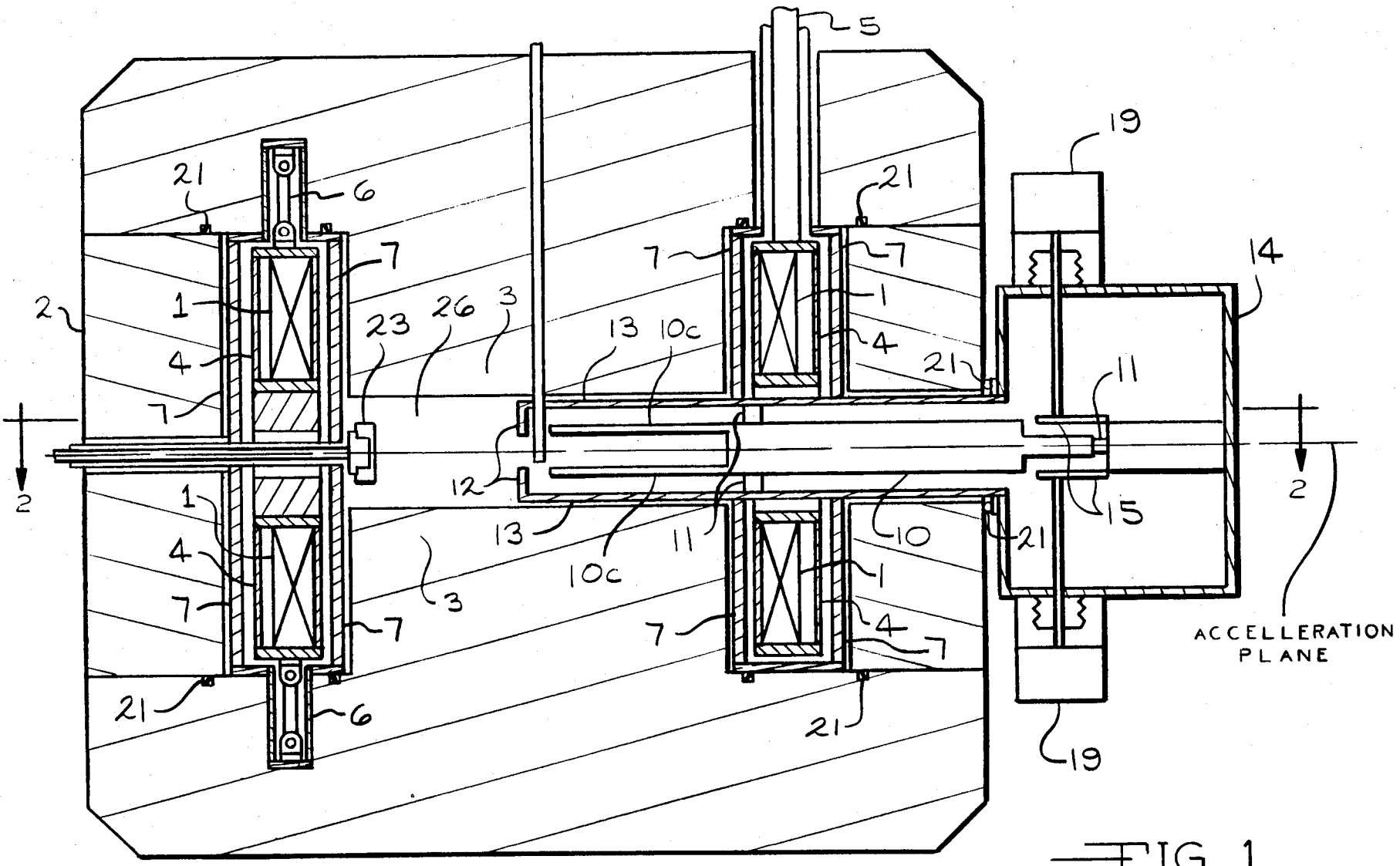

BACKGROUND OF THE INVENTION (1) Field of the Invention

The present invention relates to a superconducting synchrocyclotron. In particular the present invention relates to a synchrocyclotron with a novel main magnet excitation system which has a superconducting coil. The invention was supported by National Science Foundation Grant PHY-8312245.

(2) Prior Art

The synchrocyclotron is an apparatus which, employs the resonance principle of the cyclotron. Indeed, in its simplest form the synchrocyclotron differs from the cyclotron only in that the acceleration system is modulated in frequency to match the mass of the accelerated particle. A cyclotron operates successfully only when the mass of the ions remains constant, that is, so long as the speed of the ions is negligible as compared with the speed of light. When the mass begins to increase, the ions fall out of step with the electric field and gain no more energy from it. In the synchrocyclotron these restrictions are circumvented by periodically decreasing the frequency of oscillation, f, of the acceleration system. The beam of ions then emerges as a series of pulses, one for each decrease in the frequency of oscillation.

Synchrocyclotrons, also called frequency modulated cyclotrons, have been used for many years for the acceleration of light ions i.e. protons, deuterons, and alpha particles. Some light heavier ions such as carbon have also been accelerated in synchrocyclotrons. Overall, when requirements on beam intensity and precision are modest, the synchrocyclotron tends to be a competitive choice over the ioschronous cyclotron in the general energy range of 1 GeV and below. This is principally due to the fact that the synchrocyclotron is considerably less complicated than an isochronous cyclotron with fewer precision parts and is therefore less costly.

In recent years the successful medical use of proton and alpha beams from synchrocyclotrons for treatment of diseases of the eye and of the pituitary gland in humans has led to consideration of possible wide use of these ion accelerators in hospitals, In this and other applications, if a superconducting synchrocyclotron could be substituted for the conventional non-superconducting synchrocyclotron, the overall accelerator system would be much smaller, easier to install, and total cost would be reduced by a large factor.

OBJECTS

It is therefore an object of the present invention to provide a superconducting synchrocyclotron which is relatively inexpensive to construct and light in weight. These and other objects will become increasingly apparent by reference to the following description and the drawings.

IN THE DRAWINGS

Figure 2:
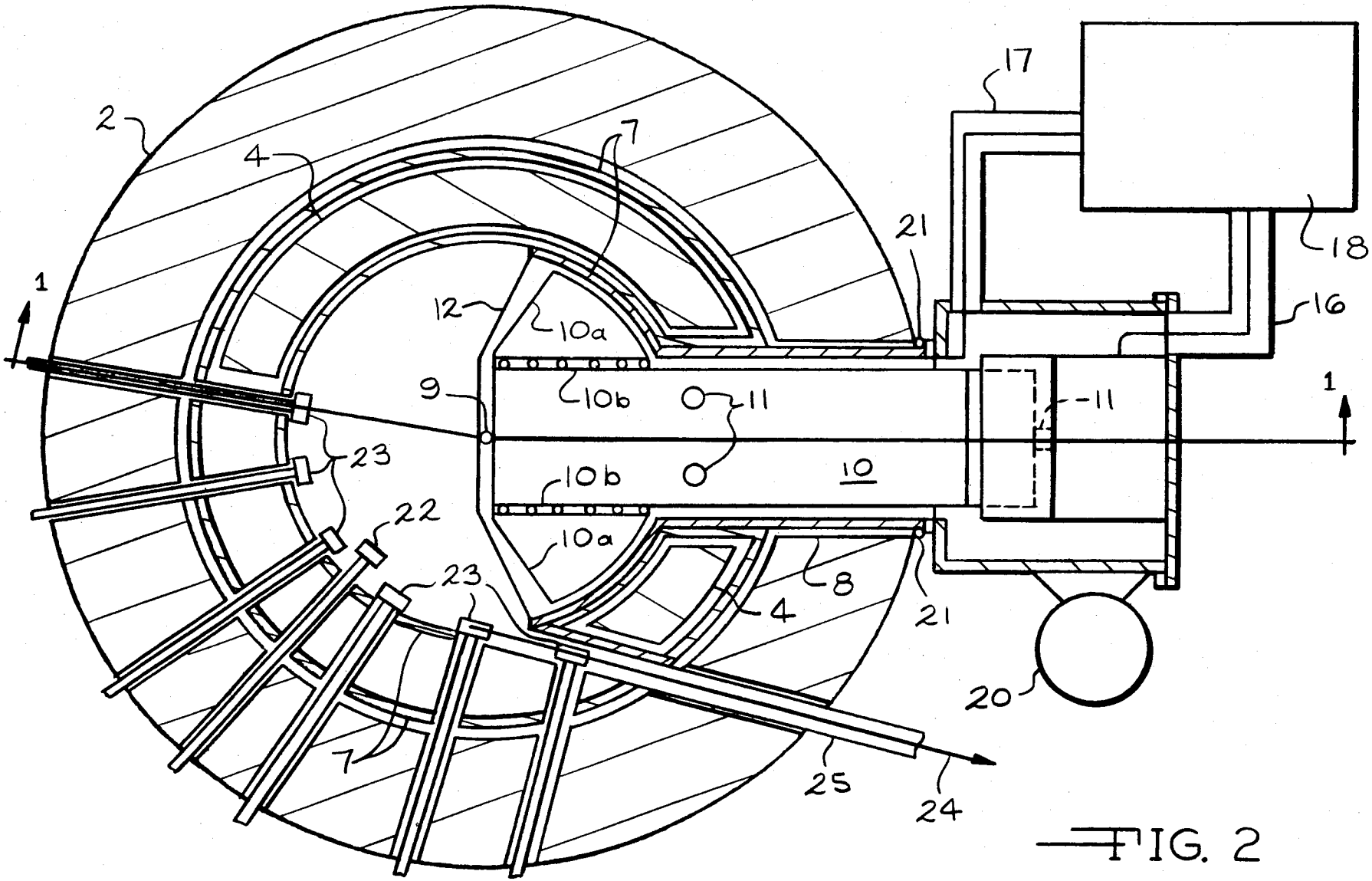

FIG. 1 is a cross-sectional front view of the superconducting synchrocyclotron of the present invention along line B—B of FIG. 2, particularly showing the positioning of the accelerating electrode 10.

FIG. 2 is a cross-sectional plan view of the synchrocyclotron along line A—A of FIG. 1, particularly showing the wings 10*a* on spaced apart plates 10*c* of the electrode 10.

GENERAL DESCRIPTION

The present invention relates to a synchrocyclotron apparatus including source means on the central axis (a—a) inside an acceleration chamber for providing atomic or subatomic charged particles to be spirally accelerated in the cyclotron, with electrical coils around two spaced apart iron magnetic poles, RF generator means connected to RF accelerating electrodes for accelerating the charged particles synchronously in the acceleration chamber to generate a pulsed beam of the atomic or subatomic particles from the spirally accelerated charged particles, the improvement which comprises:

a pair of superconducting coils mounted on the poles inside a vessel which can contain a liquified gas at about 0° K. to cool the coils;

electrical supply means for providing a large electrical current through the coils to create a high magnetic field between the poles;

liquid supply means for providing liquified gas to the coils and vessels; and support means for holding the coils in position around the poles which thermally insulate the coils from the magnetic poles.

The present invention relates to a preferred synchrocyclotron apparatus including a source means on the central axis (a—a) inside an acceleration chamber for providing atomic or subatomic charged particles to be spirally accelerated in the cyclotron, with electrical coils around two spaced apart iron magnetic poles, RF generator means connected to RF accelerating electrodes for accelerating the charged particles synchronously in the acceleration chamber to generate a pulsed beam of the atomic or subatomic particles from the spirally accelerated charged particles, the improvement which comprises:

a RF electrode adjacent the charged particle source means mounted inside the acceleration chamber and leading from outside the synchrocyclotron with a pair of spaced apart plates at an end of the electrode and located in one half of the chamber around the ion source, the plates having spaced apart parallel surfaces between which the charged particles are synchronously accelerated by the RF and each surface having opposed sides;

dummy electrodes adjacent to each of the spaced apart plates and the ion source for providing an electrical field between the spaced apart plates and the dummy electrodes;

adjustable tuning means coupled to the electrode and mounted on the outside of the synchrocyclotron for varying the frequency of the RF in the electrode so as to synchronously accelerate the charged particles between the plates;

a pair of superconducting coils mounted on the poles inside a vessel which can contain a liquified gas at about 0° K. to cool the coils;

electrical supply means for providing a large electrical current through the coils to create a high magnetic field between the poles;

liquid supply means for providing liquified gas to the coils and vessels; and support means for holding the coils in position around the poles which thermally insulate the coils from the magnetic poles.

SPECIFIC DESCRIPTION

The superconducting synchrocyclotron of the present invention is shown in FIGS. 1 and 2. A pair of cylindrical superconducting coils 1 are arranged symmetrically above and below an acceleration plane and are enclosed in an iron yoke 2 which has re-entrant poles 3 such that as the coils 1 are energized a strong magnetic field is produced between the poles 3. A typical magnetic field strength in the acceleration plane in this application would be 5 tesla.

The superconducting coils 1 are contained in a closed stainless steel helium vessel 4, filled with helium or other liquid gas through appropriate refrigeration and electrical connections 5, supported by appropriate low heat leak support members 6 and housed in a surrounding cryostat 7. The space between the helium vessel 4 and the cryostat 7 provides thermal insulation, via use of vacuum, superinsulation, intermediate temperature shields, and the like so that the helium vessel can operate at a temperature near 4 degrees Kelvin and be at the same time in close proximity to room temperature components of the cyclotron.

An RF accelerating electrode, or "dee", 10, is inserted through an opening 8 in the magnet yoke 2, the accelerating electrode 10 extending into close proximity with an ion source 9 located near the yoke 2 or pole 3 axis a—a. The electrode 10 includes parallel plates 10*c* which are at the end of the electrode 10. For each of installation and to reduce electrical capacitance, the accelerating electrode 1 is preferably constructed with removable wings 10*a* attached with bolts 10*b* or other holding means. The accelerating electrode 10 is supported on insulators 11 and creates an electric field between the active electrode 10 and a dummy electrode 12, the electric field varying in time at a radio range frequency matching the cyclotron orbital frequency of the ion to be accelerated. The system is also designed so that the desired frequency corresponds to a natural electrically resonant frequency of a complicated resonant cavity consisting of the active electrode 10, plates 10*c*, the dummy electrode 12, an outer electrical liner 13, a tuning end-box 14, and tuning panels 15. The electrode 10 is coupled and driven through coaxial plate and grid lines 16 and 17 by a high power oscillator 18.

The RF frequency required is high, in the range of 80 MHz. A system designed to oscillate in the natural "three-quarter lambda" mode in the electrode 10 is preferably the optimum design. The frequency varies as the tuning panels 15 are moved by mechanical drive units 19 so as to maintain synchronism with the orbital frequency of the ions as they accelerate.

The acceleration chamber 26 is evacuated by vacuum pumps 20 which are located on the side of the RF tuning end-box 14. Appropriate seals 21 are provided at various magnet joints. Many other arrangements of vacuum system would also be possible.

With the ion source 9 activated, beam 24 is accelerated on each modulation cycle of the radio frequency system to the outer radium of the magnet poles 3 where it is driven into an unstable orbit by a regenerator 22 and guided out through the fringing field of the magnet poles 3 by an array of magnet channels 23, all of these elements mounted on appropriate drive mechanisms (not shown) for focusing the beam. The beam 24 then follows the path 25 out of the accelerator and from there is transported by conventional means to the desired point of usage. The support means could include use of pivotal cyclotron mounts as described in application Ser. Nos. 355,337, filed Mar. 8, 1982 and 604,089 filed Apr. 26, 1984 by some of the inventors herein; however, it is preferably fixed in position. The poles 3 can have hills and valleys on the opposing faces (not shown) and a radial spiral as shown in these prior applications for stronger axial focusing.

A configuration of such a cyclotron of interest for medical applications would involve a system designed to accelerate protons to 250 MeV. Operating the magnet at 5 tesla gives a cyclotron weighing approximating 80 tons, which compares very favorably with the 1000 ton weight of a 240 MeV normal synchrocyclotron constructed in 1946–48 at the University of Rochester. The superconducting synchrocyclotron preferably has a 19 inch extraction radius of the poles 3. The RF is preferably between 50 to 100 MHz. The coils 1 require approximately 2 (preferably between 1 and 3) million amp/turns each, the outer diameter of the yoke 2 is approximately 100 inches, and the total length of the RF system from cyclotron center axis (a—a) to the side end of electrode 10 is approximately 74 inches (operating in the three-quarter lambda mode). Preferably the magnetic field is approximately equally distributed around the axis (a—a) of the synchrocyclotron.

The apparatus can have magnetic poles which contains hills and valleys to produce an azimuthal variation of the field thereby strengthening axial focusing of the beam. The apparatus also can also have hills and valleys which spiral radially to produce still stronger axial focusing.

As can be seen from the foregoing description, a unique synchrocyclotron is described. Numerous variations will occur to those skilled in the art and all of these variations are intended to be included within the scope of the present invention.

We claim:

1. In a synchrocyclotron apparatus including source means on the central axis (a—a) inside an acceleration chamber for providing atomic or subatomic charged particles to be spirally accelerated in the cyclotron, with electrical coils around two spaced apart iron magnetic poles, RF generator means connected to an RF accelerating electrodes for accelerating the charged particles synchronously in the acceleration chamber to generate a pulsed beam of the atomic or subatomic particles from the spirally accelerated charged particles, the improvement which comprises:

(a) a pair of superconducting coils mounted on the poles inside a vessel for containing a liquified gas at about 0° K. to cool the coils;

(b) electrical supply means for providing a large electrical current through the coils to create a high magnetic field between the poles;

(c) liquid supply means for providing liquified gas to the coils and vessels; and (d) support means for holding the coils in position around the poles which thermally insulate the coils from the magnetic poles.

2. In a synchrocyclotron apparatus including source means on the central axis (a—a) inside an acceleration chamber for providing atomic or subatomic charged particles to be spirally accelerated in the cyclotron, with electrical coils around two spaced apart iron magnetic poles, RF generator means connected to an RF accelerating electrodes for accelerating the charged particle synchronously in the acceleration chamber to generate a pulsed beam of the atomic or subatmoic particles from the spirally accelerated charged particles, the improvement which comprises:

(a) an RF electrode adjacent the charged particle source means mounted inside the acceleration chamber and leading from outside the synchrocyclotron with a pair of spaced apart plates at an end of the electrode and located in one half of the chamber around the ion source, the plates having spaced apart parallel surfaces between which the charged particles are synchronously accelerated by the RF and each surface having opposed sides;

(b) dummy electrodes adjacent to each of the spaced apart plates and the ion source for providing an electrical field between the spaced apart plates and the dummy electrodes;

(c) adjustable tuning means coupled to the electrode and mounted on the outside of the synchrocyclotron for varying the frequency of the RF in the electrode so as to synchronously accelerate the charged particle between the plates;

(d) a pair of superconducting coils mounted on the poles inside a vessel for containing a liquified gas at about 0° K to cool the coils;

(e) electrical supply means for providing a large electrical current through the coils to create a high magnetic field between the poles;

(f) liquid supply means for providing liquified gas to the coils and vessels; and (g) support means for holding the coils in position around the poles which thermally insulate the coils from the magnetic poles.

3. The synchrocyclotron of claim 2 wherein the spaced apart plates have an arcuate shape around the ion source.

4. The synchrocyclotron of claim 3 wherein wings are removably secured to the sides of the plates to provide the arcuate shape.

5. The synchrocyclotron of claim 2 wherein the tuning means includes mechanically and linearly movable spaced apart RF panels for varying the frequency of the RF in the electrode.

6. The apparatus of claim 2 wherein the dummy electrodes also have an arcuate shape adjacent the ion source.

7. The apparatus of claim 1 wherein a beam in the chamber is removed by means of a regenerator and magnetic fields adjacent the poles at a maximum radius from the axis.

8. The apparatus of claim 1 wherein the coils have about 1 to 3 million amp/turns.

9. The apparatus of claim 1 wherein the electrode has a length corresponding to about three-quarter lambda wherein lambda is the wave length.

10. The apparatus of claim 7 wherein the RF has a frequency of between about 50 and 100 MHz.

11. The apparatus of claim 1 wherein the synchrocyclotron is circular in cross-section around the poles and axis and wherein the magnetic field is approximately equally distributed around the poles.

* * * * *